US005385347A

United States Patent [19]

Halliburton

[11] Patent Number: 5,385,347

[45] Date of Patent: Jan. 31, 1995

[54] COIN OPERATED AMUSEMENT DEVICE

[75] Inventor: Ronald D. Halliburton, Delray Beach, Fla.

[73] Assignee: Benchamark L.C., Pompano Beach, Fla.

[21] Appl. No.: 213,054

[22] Filed: Mar. 15, 1994

[51] Int. Cl.[6] ..... A63F 7/02; A63F 9/24

[52] U.S. Cl. ..... 273/142 R; 273/138 A; 273/142 B

[58] Field of Search ..... 273/142 R, 142 B, 142 K, 273/138 R, 86 C, 86 B, 85 C, 355, 356, 138 A, 119 A, 118 A

[56] References Cited

U.S. PATENT DOCUMENTS

| | | | |
|---|---|---|---|
| 4,240,536 | 12/1980 | Noell, Jr. | 273/355 |
| 4,303,248 | 12/1981 | Shoemaker, Jr. et al. | 273/356 |
| 5,071,127 | 12/1991 | Bromley et al. | 273/85 A |
| 5,292,127 | 3/1994 | Kelly et al. | 273/138 R |

*Primary Examiner*—Benjamin H. Layno

*Attorney, Agent, or Firm*—Lane, Aitken & McCann

[57] ABSTRACT

In a coin operated amusement device, an inclined track is provided to receive a rolling coin. A rotating wheel is positioned adjacent the lower end of the track. The wheel is rotated at a constant low speed and defines payoff positions distributed around the wheel. Payoffs to the player are provided when a coin passes by the wheel in the track opposite a payoff position.

10 Claims, 6 Drawing Sheets

COIN OPERATED AMUSEMENT DEVICE

BACKGROUND OF THE INVENTION

This invention relates to a gaming amusement device of a coin actuated type.

Coin actuated gaming amusement devices come in many different forms. Most of the gaming devices operate on pure chance and involve very little, if any, skill on the part of the player. Moreover, the devices are complicated mechanically and are quite expensive to build and maintain.

SUMMARY OF THE PRESENT INVENTION

The coin actuated gaming device of the present invention is designed to reward the skill of the player and is relatively simple in design and, accordingly, is relatively inexpensive to manufacture.

In accordance with the invention, one or two coin receiving slots are arranged to receive coins which are directed to an inclined track so that coins roll along the track toward a slowly rotating wheel which is arranged to rotate in a vertical plane. The track guides the rolling coin to roll past the periphery of the wheel. The wheel defines a plurality of payoff positions of different values distributed around the wheel. The width of each payoff position varies inversely with the payoff value. Photodetectors are provided to detect whether a payoff position is opposite the coin track when a coin passes the periphery of the wheel. If the coin passes the periphery of the wheel when a payoff position is opposite the coin track, the player is awarded in accordance with the value of the payoff position. The rotating wheel and the payoff positions on the rotating wheel are visible to the player, who uses his or her skill to try to time the insertion of the coin into the slot relative to the position of the wheel so as to cause the coin to pass the periphery of the wheel opposite a payoff position on a wheel.

In accordance with the preferred embodiment of the invention, two coin receiving slots which introduce coins into separate tracks which merge into a single track. This arrangement enables a player to insert two coins very close in time to attempt to cause two coins rolling in the track to pass the periphery of the wheel very close together so as to increase the chances of at least one of the coins being opposite a payoff position.

DESCRIPTION OF THE PREFERRED EMBODIMENTS

Figure 1:
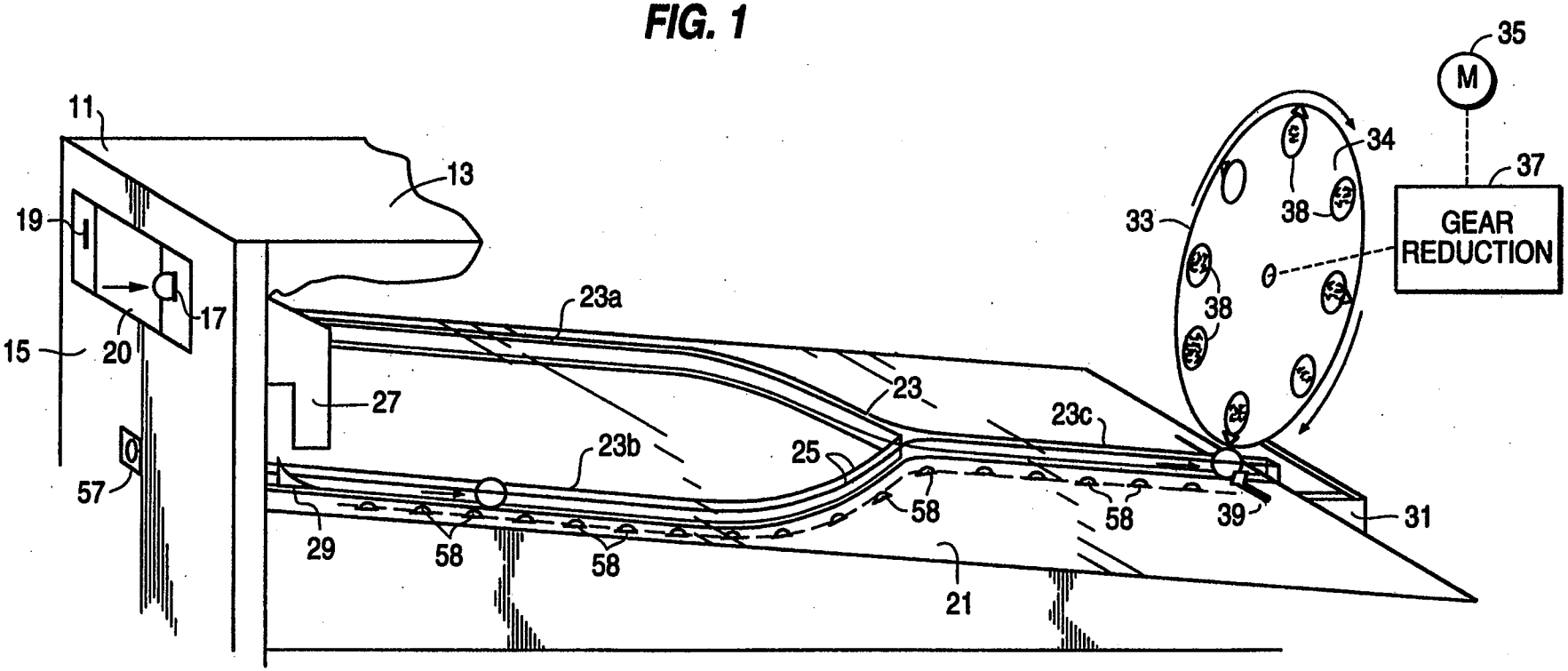
FIG. 1 is a perspective view partially broken away schematically illustrating coin operated amusement device of the invention.

As shown in the drawings, the gaming device of the present invention comprises a cabinet 11 having a transparent top wall 13 and a front wall 15 with two coin receiving slots 17 and 19 and a transparent front panel 20. Within the cabinet 11 is a generally horizontal panel 21 which is inclined so as to define a surface which is inclined downwardly extending from the front wall 15 to the back of the cabinet. A Y-branched coin track 23 is mounted on the inclined surface of the panel 21. The coin track has two branches **23*a* and 23*b* which extend to the front wall 11 to locations beneath the coin slots 17 and 19. The branches 23*a* and 23*b* join into a single trunk section 23*c* which extends to the back side of the inclined surface. The track 23 comprises two closely adjacent transparent parallel vertical walls 25 which have a vertical height about $\frac{3}{4}$ of the height of a coin designed to be received in the track. The vertical height of the wall preferably should be less than the diameter of the coins to be received so that the top coins rolling in the track 23 can be observed above the track through the top transparent top wall 13 and front panel 20. The spacing between the walls 25 should be small enough to maintain a coin received in the track on edge so that it will roll in the track and it should be large enough in the portions 23*a* and 23*b* to permit a coin rolling loosely on edge to freely roll in the track without substantial friction interference from the walls 25. In the trunk section 23*c*, the walls should be separated by a sufficient distance to enable two coins to roll side by side through the track 23*c* without substantial friction interference from the walls for reasons to be explained below. This means that the walls of the trunk section 23*c* will be more widely spaced than in the branches 23*a* and 23*b*. Accordingly, two coins rolling down the track branches 23*a* and 23*b* and reaching the junction between these tracks simultaneously will roll together side by side through the trunk section 23*c*** of the track.

Coins inserted into the slots 17 and 19 are received in coin acceptors 27 which are commercially available devices designed to detect spurious coins or slugs and to reject such spurious coins and only allow genuine coins to pass through the acceptors 27. A coin passing through the coin acceptor 27 will be ejected with a predetermined velocity by the acceptor toward the track branch **23*a* or 23*b*. Below each coin acceptor 27 in each track branch 23*a* and 23*b* is a ramp 29 having a slightly concave surface and designed to receive a genuine coin ejected from the coin acceptor 27 toward the track and start the coin rolling in the coin track. The concave surfaces of the ramps 29 serve to eliminate coin bouncing in the track and tend to bring about a stabilized rolling motion of the coin in the track. A coin inserted into one of the branches 23*a* and 23*b* will roll down through the junction of the branches and into the trunk section 23*c* and then roll through the trunk section and out the back end of the trunk section 23*c* into a coin collector 31. At the back of the inclined panel 21 is a vertically oriented wheel 33 which is in the form of a solid disk and which has a front face 34 facing toward the front end of the cabinet to be at least partly visible by a player standing at the front end of the cabinet. The upper part of the wheel may be partly obscured by a vertical panel (not shown) extending up from the transparent top wall 13 in front of the wheel 33. The lower portion of the wheel is fully visible through the transparent wall 13 and the panel 20. The wheel 33 is rotated on its axis driven by a motor 35 through a gear reduction drive 37 so that the wheel rotates relatively slowly, preferably at a rate of 18 r.p.m. A plurality of payoff positions are distributed around the wheel 33 and these payoff positions are indicated by circles 38 marked on the front of the wheel. The value of each payoff position is indicated in the circle. These circles and their values are visible to the player standing at the front of the cabinet 11** as the wheel rotates.

In operation, if a coin passes beneath the wheel 33 while a payoff position is opposite the track 23, this occurrence will be detected as a hit and the device will dispense a number of tickets corresponding to the payoff value. Thus, if the payoff value is 5, the player will receive 5 tickets, and if the payoff value is 50, the player will receive 50 tickets. The payoff positions have different widths on the wheel 33 and the higher the value of a payoff position, the narrower the width of the payoff position so that it is much more difficult to obtain a hit on a higher valued position than a lower valued position.

A hit is detected by an optical sensing system including a coin sensor 39 which detects when a coin passes through the track 23 underneath the wheel 33.

Figure 2:
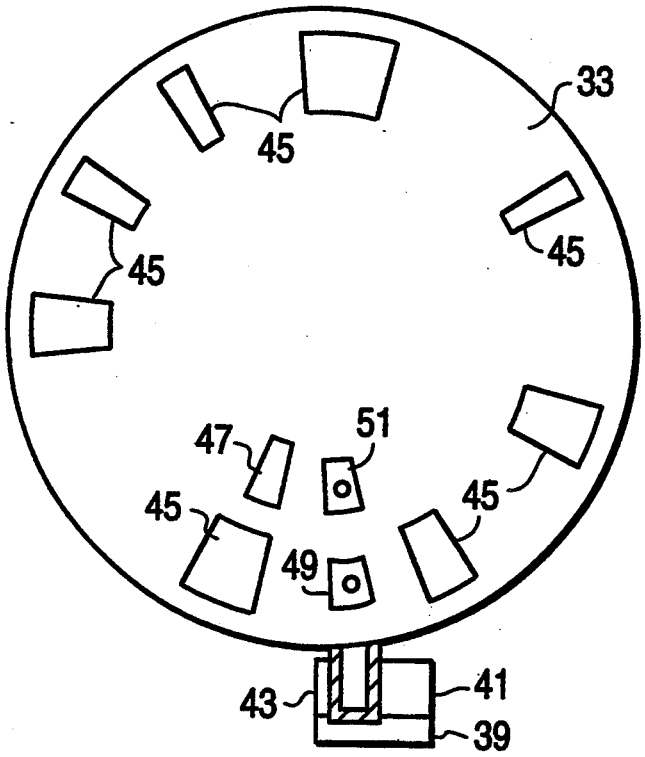
FIG. 2 is a view in elevation of the back side of the wheel and optical detection system employed in the system of the present invention.

FIG. 2 illustrates the assembly of the wheel 33, the track 23, and the coin sensor 39 from the back side of the wheel 33. The coin sensor 39 comprises a source of infrared light 41, which shines an infrared beam across the track 23 beneath the wheel 33, and an infrared photodetector 43 positioned on the opposite side of the track 23 to receive the infrared beam from the source 41. A coin passing under the wheel is detected by the coin interrupting the beam impinging upon the photodetector 43 and causing the photodetector 43 to produce an output pulse. The payoff positions are established on the back face of the wheel 31 by dark segments 45 distributed around the wheel 31 and positioned opposite the payoff indicating circles 38 on the front face of the wheel 33. The background of the back face of the wheel 33 between the dark segments 45 is white or other highly light reflecting color or surface. The width of the segments 45 inversely correspond with the payoff value so that the smaller the payoff value, the wider the segment 45 and vice versa. In addition, a home position segment 47 is provided which is also dark on the light background of the wheel 33.

The optical sensing system also includes reflectivity detector 49 to detect the segments 45 and a reflectivity detector 51 to detect the home segment 47. The reflectivity detectors 49 and 51 shine infrared beams toward the back of the wheel 33 and contain a photodetectors to detect infrared light reflected back from the back of the wheel. The detector 49 is positioned adjacent to the locus of the segments 45 so that each of the segments 45 will pass by the detector 49 to receive the infrared light beam from the photodetector 49. When the wheel 33 is positioned so that the detector 49 is opposite a space between segments 45, relatively high intensity infrared light will be reflected from the back of the wheel toward the detector 49 and when the detector 49 is opposite to a segment 45, because of the darkness of the segment 45, relatively low intensity infrared light will be reflected back toward the detector 49. The amplitude of the output signal of the detector 49 will thus indicate when a payoff segment 45 is opposite the detector 49. A hit is detected causing a payoff to occur when the pulse generated by a coin interrupting the infrared beam from the source 41 to the photodetector 43 coincides with a segment 45 being opposite the detector 49 as indicated by a low amplitude of the output signal from the reflectivity detector 49. The reflectivity detector 51 senses the passing of the home segment 47 by the detector 51 in the same manner that the detector 49 senses the passing of the payoff segments 45.

Figure 3:
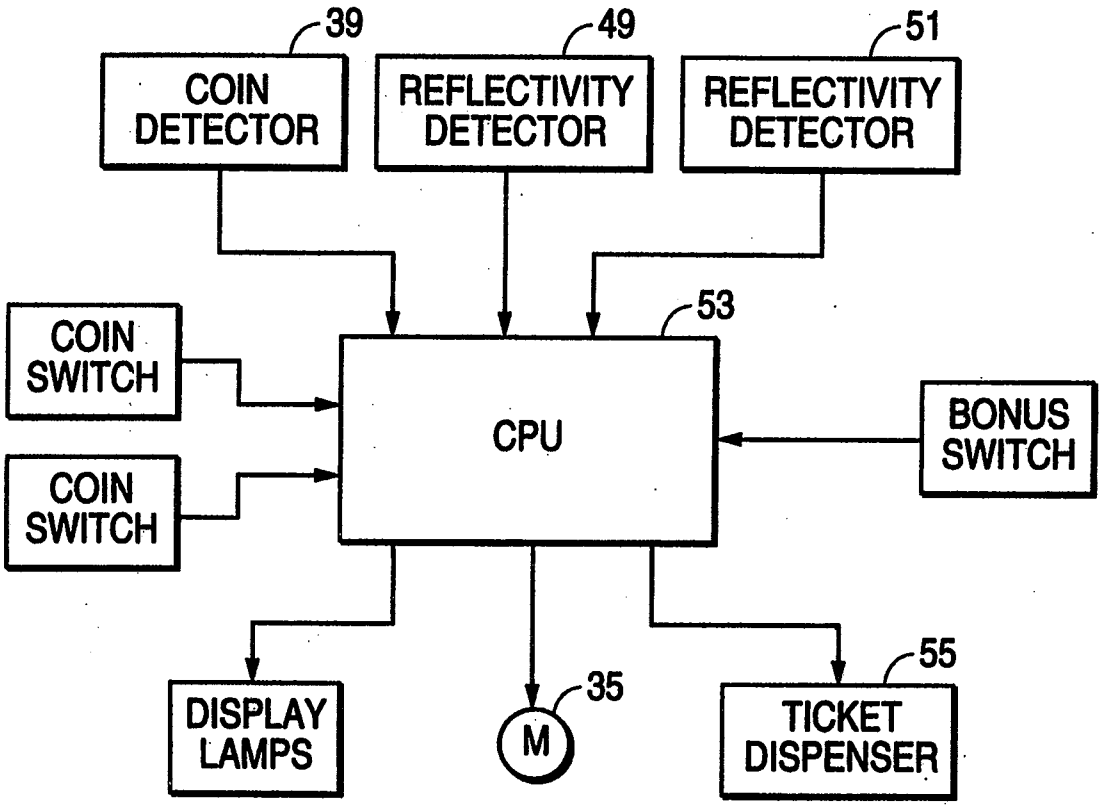
FIG. 3 is a block diagram illustrating the electronics of the system of the present invention.

As shown in FIG. 3, the output signals generated by the coin detector 39 and reflectivity detectors 49 and 51 are applied to a central processing unit 53 which has the task of determining that a pulse from the coin detector 39 is received at the same time that the output signal amplitude from the reflectivity detector 49 is low indicating that the detector 49 is opposite the payoff segment 45. When a hit is detected, the CPU 53 controls a ticket dispenser 55 to dispense the number of tickets corresponding to the value of the corresponding payoff position. The CPU 53 determines the value of the payoff by means of signals received from the home position reflectivity detector 51 combined with the signal received from the detector 49. To make this determination, the CPU in response to the signal received from the detector 49 counts each segment 45 as it reaches the detector 49. To make this count, the CPU responds to the negative going transitions of the wave form corresponding to the leading side of the segments 45 as they cross into the infrared beam generated by the detector 49. The waveform generated by the detector 49 in response to the payoff segments 45 will be a squarewave and the squarewave will have a negative going transition corresponding to the leading edge of each segment and will also have a positive going transition corresponding to the trailing edge of each segment. The CPU 53 maintains a wheel position count and increments the wheel position count in response to each positive transitions of the waveform from the detector 49. Alternatively, the CPU could respond to the positive transitions in the waveform to achieve the same result. In addition to incrementing the wheel position count maintained by the CPU 53, the CPU will also respond to the signal from the detector 51 to reset the wheel position count to zero each time the home segment 47 passes by the detector 51. Thus, a unique wheel position count will be generated by the CPU for each of the different segments 45. The CPU maintains a register of payoff values at addresses indexed by the different wheel position counts. When a hit is detected, the CPU reads out the value from the register corresponding to the current wheel position count maintained by the CPU and then uses this value to control the number of tickets dispensed by the ticket dispenser 55.

The player uses his skill to obtain a payoff from the device by attempting to time the insertion of the coin into a slot 17 or 19 so as to cause the inserted coin to roll past the wheel 33 opposite the payoff position. By viewing the rotating wheel and by experience, the player can make an estimate of the correct time to insert the coin. To increase the chances of a payoff, the player can insert a coin in both of the slots 17 and 19 to attempt to make the coins reach the junction between the branches **23*a* and 23*b* near to the same time, but not at the same time, so that the coins roll through the trunk section 23*c* of the track in tandem and thus increase the chances of a payoff position being opposite the track when one of the coins rolls past the wheel 33**.

In the preferred embodiment of the invention, when the CPU 53 detects a hit, the CPU deenergizes the motor 35 which automatically brakes to a stop, thus stopping the wheel 33 when a hit is made. After a time delay, the CPU 53 reenergizes the motor to start the wheel again. While the wheel is stopped, the CPU will not register any valid hits by coins passing through the detector 39 even through the wheel is stopped opposite a payoff position. Alternatively, the wheel could be rotated continuously with tickets being dispensed in response to each hit as the wheel continuously rotates.

In the preferred embodiment, a bonus payoff feature is provided wherein a bonus is awarded if the coin scores a hit in a selected bonus payoff position or positions. The bonus awarded is one or more free bonus plays. When a player is awarded a free bonus play, he may actuate a bonus button 57 on the front of the cabinet. In response to the bonus button 57 being actuated when the player has been awarded a bonus, the roll of a coin will be simulated by a bonus timer in the CPU. The bonus timer is designed to determine a time interval corresponding to the length of time it takes a coin to roll through the coin track 23. A hit is determined in response to a bonus button actuation if the bonus timer times out while a payoff position is opposite to the coin track 23 as determined by the detector 49. In other words, if the detector 49 is producing a low output signal at the time that the bonus timer times out in response to a valid bonus button actuation, the player will be awarded with a hit as if he had inserted a coin and obtained a hit.

Also, in the preferred embodiment, display lamps 58 are provided distributed along the path 23 extending along both the branches 23*a*, 23*b* and the trunk section 23*c*. When a coin is inserted into a slot 17 or into the slot 19, a coin switch is actuated indicating that the coin has been inserted. If the wheel at this time is not rotating, the insertion of a coin will start the wheel rotating. The actuation of a coin switch starts coin roll timers in the CPU 53. The coin roll timers control sequential energization of the display lamps 58 so that they are energized in synchronism with the coin rolling through the track. The coin roll timers cause the display lamps 58 to be turned on at the same time that the coin rolls by each display lamp. The player can see these display lamps being energized traveling down the track 23 in synchronism with the coin. This sequential energization of the display lamps thus makes the play more enjoyable by the player. The sequential energization of the display lamps 58 is also effected in response to a bonus button actuation.

As described above, the operation of the device is controlled by a central processing unit 53, which has a multi-task operating system so that the central processing unit can in effect perform several different tasks simultaneously. These tasks include a coin drop detection task which responds to a coin switch being closed in response to a coin being inserted into slot 17 or slot 19, a bonus switch detection task, which responds to a bonus switch being actuated by the bonus button 57 when the player has been awarded the bonus and a coin hit detecting task which functions to detect when a coin hit has occurred or, in the alternative, when a bonus hit has occurred and to cause the appropriate number of tickets to be dispensed to the player. In addition to the above tasks, which are performed on a time shared basis essentially simultaneously, the CPU also provides a wheel control function which keeps track of the position of the wheel by counting the payoff positions in the wheel position counter as they pass by the detector 49. The wheel position function is performed as an interrupt. Whenever the central processing unit receives a negative going transition from the detector 49 indicating that the leading edge of a payoff position has reached the spot adjacent to track 23, the program task currently being executed by the CPU 53 will be interrupted and the wheel position counter will be incremented. Similarly, when the home position detector 51 detects that the home position has reached the spot adjacent the track 23, the CPU in response to receiving this signal from the detector 51 will interrupt the task being performed and reset the wheel position counter to zero.

Figure 4:
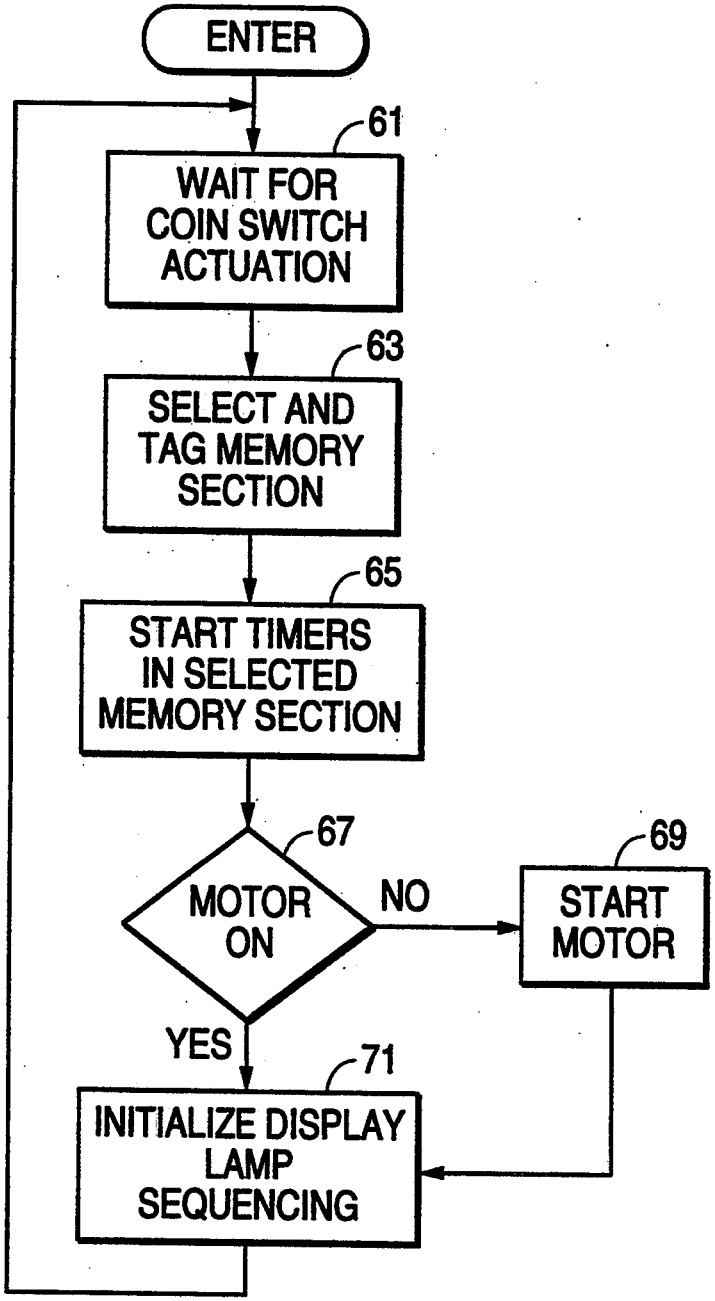
FIG. 4 is a flow chart of the coin drop detection task employed in the system of the present invention.

A block diagram illustrating the coin drop detection task is illustrated in FIG. 4. As shown in FIG. 4, the coin drop detection task waits in routine 61 for the coin switch actuation. When a coin switch has been actuated by the insertion of a coin into a slot 17 or a slot 19, the coin drop detection task moves to step 63, in which the program selects a section of memory and tags the selected memory section as being active. Following step 63, the program advances to step 65 in which two coin roll timers in the selected memory section are started. Following step 65, the program enters decision step 67 in which the program determines whether or not the motor 35 is on. If the motor is not on, the program branches to step 69 to start the motor. Following step 67 if the motor was on, or step 69 if the motor was off, the program enters routine 71 in which the program initiates the sequential energization and deenergization of the display lamps 58 distributed along the track 23. The CPU 53 will then control, the turning on of the display lamps 58 in accordance with the count in the first coin roll timer proceeding along the track from front to back so that the display lamps turn on in synchronism with the coin rolling down the track 23. The CPU 53 controls the extinguishment of the display lamps 53 behind a coin in accordance with the count in the second coin roll timer proceeding along the track 23 from front to back in synchronism with the coin rolling in the track 23, so that as the coin rolls through the track 23, the display lamps 58 will simulate a moving object moving with the coin along the track 23. The corresponding display lamps 58 on the two branches 23*a* and 23*b* of the track 23 are energized in parallel so that the simulated object moves along both branches 23*a* and 23*b* simultaneously. Following step 71, the task returns to routine 61 to await the next coin switch actuation.

Figure 5:
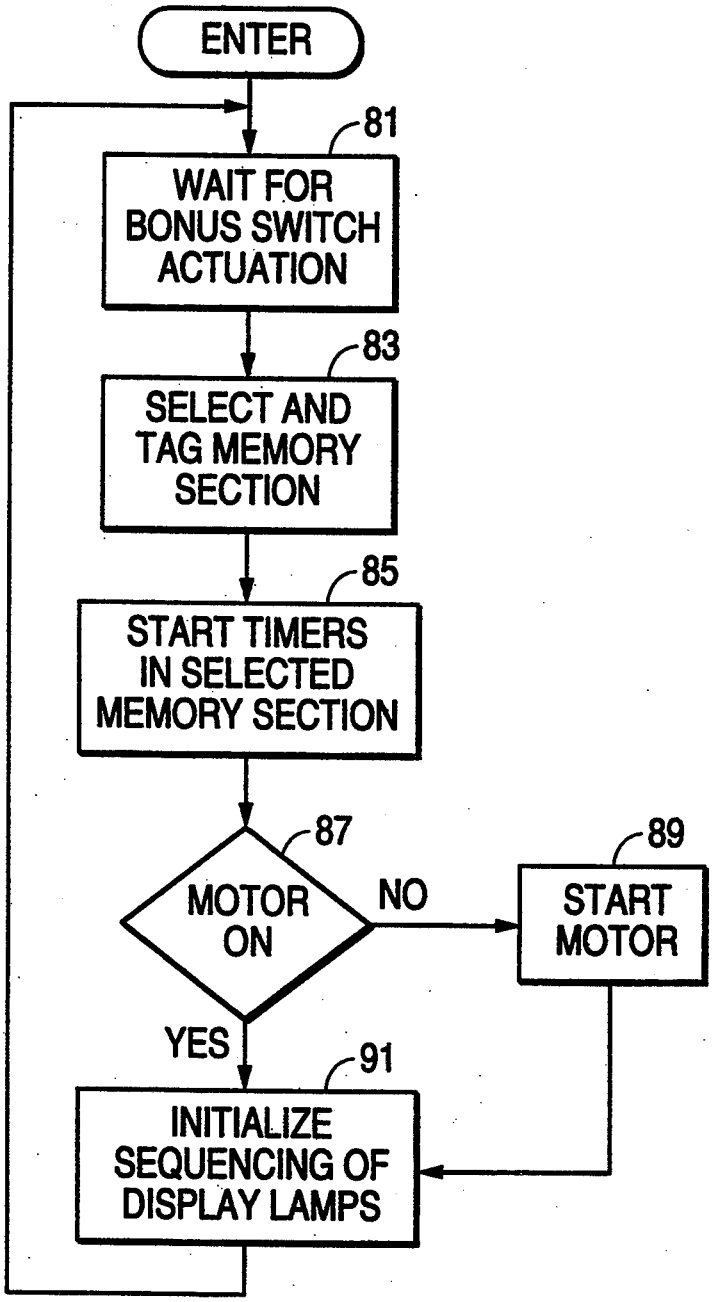
FIG. 5 is a flow chart of the bonus switch detection task employed in the system of the present invention.

FIG. 5 is a flow chart illustrating the operation of the bonus switch detection task. In this task, the program waits in routine 81 for the actuation of the bonus switch by pushing of the bonus button 57. When the bonus switch is actuated, if the player has been awarded a bonus, the task will proceed from routine 81 to the step 83 in which the program selects a memory section, tags the selected memory section as active and flags the selected memory section as being a bonus section. Following step 83, the task enters into step 85 in which two bonus timers are started in the memory section selected in step 83. Following step 85, the program moves into decision step 87 in which the program determines whether or not the motor 35 is on. If the motor is not on, the program branches to step 89 in which the motor is started. From step 87 if the motor was on, or from step 89 if the motor was off, the program proceeds into routine 91, in which the sequential energization and deenergization of the display lamps 58 under the control of the bonus timers are initiated. The CPU then carries out the sequential energization and deenergization of the display lamps in accordance with the bonus timer counts in the same manner as described above in connection with coin roll timers. As a result, simulated motion by the display lamps 58 down the track 23 will occur. In this manner, when the player presses the bonus switch button after he has been awarded the bonus, he can observe the simulated motion in the display lamps distributed along the track 23 as if a coin were rolling down the track 23 and can observe when the simulated object motion reaches the wheel 33. Following step 91, the task returns to routine 81 to await the next bonus switch actuation.

Figure 6:
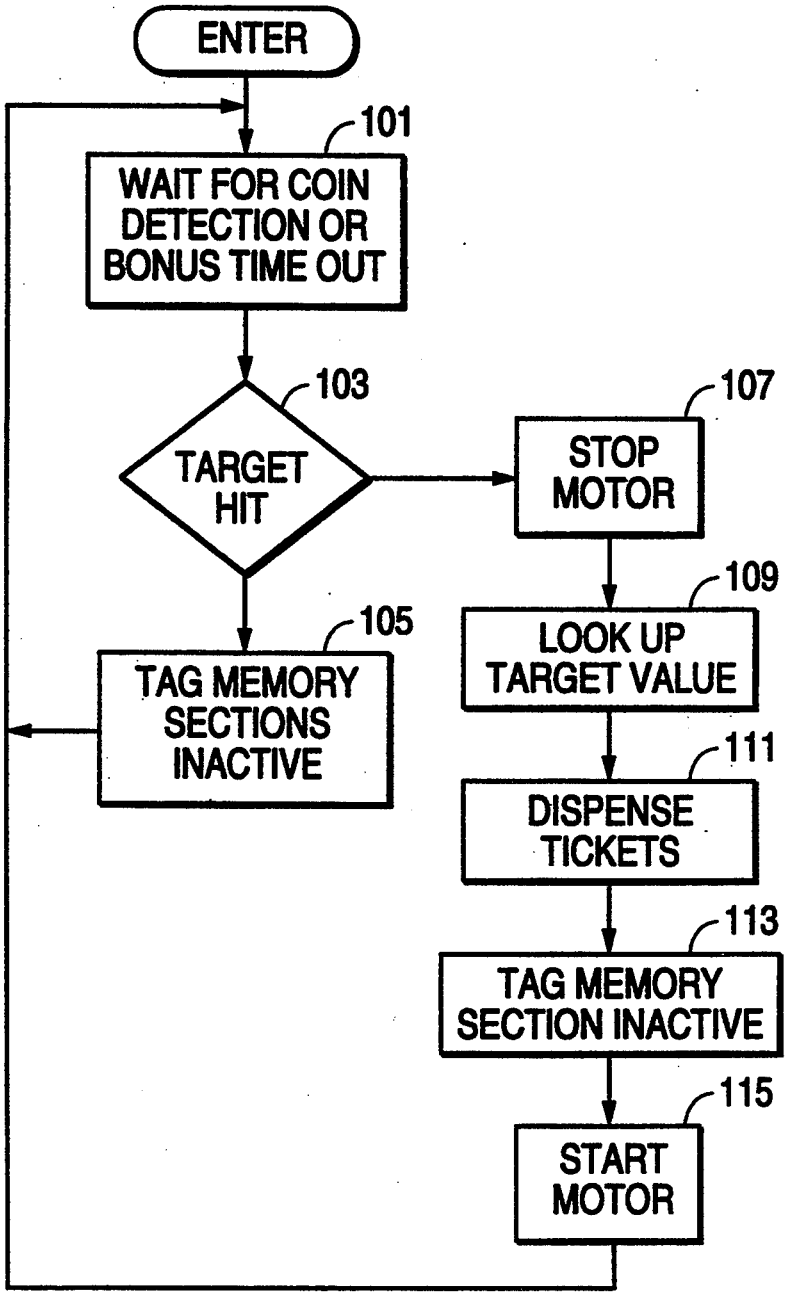
FIG. 6 is a flow chart of the coin hit detection task employed in the system of the present invention.

FIG. 6 illustrates a flow chart for the coin hit detection task. As shown in this flow chart, the program waits in step 101 for a signal from the photodetector 43 indicating that a coin has rolled past the wheel 33. When a coin is detected in step 101, the coin hit detection task moves into decision step 103, in which the program determines whether or not a target is hit by whether or not the signal from the detector 49 is low. If the decision step 103 determines that the signal from the detector is not low, there is no target hit, and the program proceeds into task 105 in which the selected memory is tagged inactive and the program returns to step 101. On the other hand, if in step 103, the program determines that the output signal from the detector 49 is low, the task branches to step 107 in which the motor 35 is stopped, whereupon the task proceeds into routine 109. In routine 109, the program determines the target value by obtaining the count in the wheel position counter and then using this value to look up the value of the target hit stored in the memory. The program then proceeds into routine 111 in which the number of tickets corresponding to the value obtained in routine 109 are dispensed. Following the routine 111, the task proceeds into step 113 wherein the selected memory section is tagged inactive, whereupon the program proceeds into step 115 in which the wheel is restarted. The task then returns to routine 101.

A bonus hit is also detected by the coin hit detection task in the following manner. If the selected memory section is flagged as a bonus section, the task will advance from the routine 101 to the decision step 103 when the first bonus timer times out. Then in the decision step 103, it will be determined whether or not the output from the detector 49 is high or low to determine whether a hit or miss has occurred at the time the first bonus timer times out just as if a coin had caused the task to advance to the decision step 103. The task then proceeds through the remaining steps of the coin hit detection task to effect a payoff of the ticket award when a bonus hit has occurred in the same manner as for coin hit as described above.

In addition to the above described tasks, the CPU 53 increments a coin counter each time a coin is detected passing the wheel by the detector 39 and at the same time, adds the coin roll time registered in the first coin roll timer to an accumulator in which the coin roll time is added to the sum of previously accumulated coin roll times. The coin roll times added together in the accumulator will each represent the actual time that it takes a coin to roll through the track 23. The average roll time for a coin is determined by dividing the sum of the accumulated roll times by the number of coins counted by the coin counter. From this average, a time increment is determined to set the rate of sequencing of the display lamps 58 to be synchronized with a coin rolling the track 23. The time increment is computed by dividing the average coin roll time by a divisor corresponding to the length of the coin roll track. This divisor is approximately equal to the number of equally spaced display lamps distributed along one coin roll path from a coin acceptor 27 through one of the branches **23*a* or 23*b* and through the trunk section 23*c* to the coin detector 39. The CPU 53 energizes the next display lamp in the sequence proceeding along the track after expiration of this time increment following the energization of the previous display lamp in the sequence. The CPU also deenergized each display lamp after expiration of this time increment following the deenergization of the previous display lamp in the sequence. In this manner, the motion of the simulated object by the display lamps 58** corresponds with the actual average roll time of the coins. The average roll time is also used to determine the timing out of the first bonus timer so as to correspond with the actual average roll time of the coins.

If a selected memory section is active when a coin switch is actuated or when the bonus switch is actuated, the coin drop detection task selects another memory section and tags it active so that more than one memory section can be selected and tagged as active while two or more coins are rolling in the track 23 or so that a bonus play may be carried out while one or more coins is simultaneously rolling in the track 23. The coin hit detection task acts on the oldest active selected memory section so that the correct memory section gets tagged inactive and so that the correct coin roll time gets accumulated in the accumulator.

The above description is of a preferred embodiment of the invention and modification may be made thereto without departing from the spirit and scope of the invention which is defined in the appended claims.

I claim:

1. A coin operated amusement device comprising means defining a coin track to guide a rolling coin in a predetermined path, a payoff wheel positioned adjacent to said path and defining at least one payoff position at an angular position on said wheel, means to rotate said wheel on the axis of said wheel, and means to determine when a coin rolling in said path passes said wheel opposite said payoff position.

2. A coin operated amusement device as recited in claim 1, wherein said wheel defines a plurality of payoff positions distributed around said wheel and wherein said coin detecting means detects when a coin rolling in said path passes said wheel opposite one of said payoff positions.

3. A coin operated amusement device as recited in claim 2, wherein said payoff positions have different values and wherein said device determines the value of the payoff position opposite a coin detected by said coin detecting means.

4. A coin operated amusement device as recited in claim 3, further comprising means to dispense a payoff corresponding to the value determined by said value determining means.

5. A coin operated amusement device as recited in claim 4, wherein said dispensing means dispenses said payoff in the form of tickets.

6. A coin operated amusement device as recited in claim 1, wherein said coin track is Y-shaped having at least two branches to receive coins and a trunk section connected to said branches extending past said wheel whereby coins received in either of said branches will roll through said trunk section past said wheel.

7. A coin operated amusement device as recited in claim 1, further comprising means to define a coin slot and means to accept coins received in said coin slots and to cause the received coins to roll in said coin track.

8. A coin operated amusement device as recited in claim 1, wherein said coin track is inclined to cause said coin to roll through said track past said wheel by gravity.

9. An coin operated amusement device as recited in claim 1, wherein said coin track is mounted in a cabinet, said cabinet defining a coin receiving slot and having means to direct a coin received in said slot into said coin track, said cabinet having a transparent wall so that coins rolling in said track are visible through said wall.

10. A coin operated amusement device as recited in claim 9, wherein payoff indicators are displayed on the front surface of said wheel indicating the location of payoff positions on said wheel and wherein said wheel is positioned and located to be at least partly visible from the front side of said cabinet.

* * * * *

UNITED STATES PATENT AND TRADEMARK OFFICE

CERTIFICATE OF CORRECTION

PATENT NO. : 5,385,347

DATED : January 31, 1995

INVENTOR(S) : Ronald D. Halliburton

It is certified that error appears in the above-indentified patent and that said Letters Patent is hereby corrected as shown below:

On the title page, item [73], the assignee's name should be

--Benchmark Entertainment L.C.--

Signed and Sealed this

Third Day of December, 1996

*Attest:*

*Attesting Officer*

BRUCE LEHMAN

*Commissioner of Patents and Trademarks*